US007172467B1

(12) United States Patent
Yohn et al.

(10) Patent No.: US 7,172,467 B1
(45) Date of Patent: Feb. 6, 2007

(54) ELECTRICAL CONTACT ASSEMBLY

(75) Inventors: Brent David Yohn, Newport, PA (US); William Henry Bernhart, Monroe, WA (US); Richard Paul Walter, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/284,447

(22) Filed: Nov. 22, 2005

(51) Int. Cl.
*H01R 13/502* (2006.01)

(52) U.S. Cl. ..... 439/686; 439/744

(58) Field of Classification Search ..... 439/686, 439/695, 599, 744
See application file for complete search history.

(56) References Cited

U.S. PATENT DOCUMENTS 2,419,018 A * 4/1947 Gudie ..... 439/744
2,999,221 A * 9/1961 Ellis et al. ..... 439/744
3,177,464 A * 4/1965 Solorow et al. ..... 439/695
3,818,420 A * 6/1974 Barr ..... 439/261
4,214,802 A * 7/1980 Otani et al. ..... 439/275
4,421,378 A * 12/1983 Sanford et al. ..... 439/686
4,746,310 A * 5/1988 Morse et al. ..... 439/620
4,808,127 A * 2/1989 Swanic ..... 439/139
4,820,204 A * 4/1989 Batty ..... 439/681
5,181,860 A * 1/1993 Honma et al. ..... 439/321
6,616,482 B2 9/2003 De La Cruz et al.
6,669,502 B1 12/2003 Bernhart et al.
6,908,346 B1 6/2005 Hyzin
6,945,795 B1 * 9/2005 Gross III et al. ..... 439/92

* cited by examiner

*Primary Examiner*—Tulsidas C. Patel
*Assistant Examiner*—Vladimir Imas

(57) ABSTRACT

An electrical contact assembly includes a contact, a front shell member, and a rear shell member. The front shell member has a core with a front contact passage therethrough to receive the contact. The core is formed with a shroud extending from a front end of the front shell member, and the shroud surrounds and defines a cavity. The front shell member is formed of an integral single piece of non-conductive material. The rear shell member has a core with a rear contact passage therethrough to receive the contact. The rear shell member is coupled to the front shell member such that the front and rear contact passages are substantially aligned along a contact passage axis. The rear shell member is formed of an integral single piece of non-conductive material.

20 Claims, 4 Drawing Sheets

ELECTRICAL CONTACT ASSEMBLY

BACKGROUND OF THE INVENTION

This invention relates generally to electrical contact assemblies, and more particularly, to an axial contact assembly for positioning and retaining wires and contacts in a fixed position.

Aeronautical Radio, Inc. ("ARINC") is a commercial standards group governing connectors, connector sizes, rack and panel configurations, etc, primarily for airborne applications. Connectors which conform to ARINC specifications are sometimes referred to as ARINC connectors. One example of an ARINC connector is the ARINC Size 8 Quadrax connector that receives size 8 Quadrax connectors. The Quadrax connector is a multi-signal contact system employing two differential pairs used with quad-axial cables for databus applications on commercial aircraft per ARINC 600, 664 and 763. In addition to commercial avionics, aircraft data networks and in-flight entertainment systems, the Quadrax connector can be used in military networking and communications as well as multi-gigabit applications like Gigabit Ethernet IEEE 802.3Z and Fibre Channel XT11.2. The Quadrax connector consists of four contacts arranged within a size 8 shell having a connector envelope defined according to ARINC standards. Typically, the Quadrax connector includes an insulative body having four channels for receiving the four contacts. The insulative body is received within a size 8, metallic outer shell. A Quadrax style connector that receives the Quadrax contacts is typically metal or metalized plastic that provides a pathway to ground from the size 8 Quadrax outer shell.

BRIEF DESCRIPTION OF THE INVENTION

In one aspect, an electrical contact assembly is provided including a contact, a front shell member, and a rear shell member. The front shell member has a core with a front contact passage therethrough to receive the contact. The core is formed with a shroud extending from a front end of the front shell member, and the shroud surrounds and defines a cavity. The front shell member is formed of an integral single piece of non-conductive material. The rear shell member has a core with a rear contact passage therethrough to receive the contact. The rear shell member is coupled to the front shell member such that the front and rear contact passages are substantially aligned along a contact passage axis. The rear shell member is formed of an integral single piece of non-conductive material.

Certain embodiments of the electrical contact assembly may include a keying feature for limiting rotational movement between the front and rear shell members, or between the front and rear shell members and a mating contact assembly. A retention clip may be received within at least one of the front and rear contact passages, wherein the retention clip engaging the contact when the contact is loaded into the front and rear contact passages. Optionally, the retention clip includes a tubular body and a tab element extending inwardly from the tubular body. The tab element secures the contact with respect to the tubular body. In one embodiment, the contact may include a shoulder, and the retention clip may engage the shoulder to limit movement of the contact with respect to the retention clip.

In another aspect, an electrical contact assembly is provided including a pin contact, a front shell member, and a rear shell member. The front shell member has a core with a front contact passage therethrough to receive the pin contact, and the front shell member is formed of an integral single piece of non-conductive material. The rear shell member has a core with a rear contact passage therethrough to receive the pin contact. The rear shell member is coupled to the front shell member such that the front and rear contact passages are substantially aligned along a contact passage axis. The rear shell member is formed of an integral single piece of non-conductive material. A retention clip is received within at least one of the front and rear contact passages. The retention clip engages the pin contact when the pin contact is loaded into the front and rear contact passages.

In a further aspect, an electrical contact assembly is provided including a socket contact, a front shell member, and a rear shell member. The front shell member has a core with a front contact passage therethrough to receive the socket contact, and the front shell member is formed of an integral single piece of non-conductive material. The rear shell member has a core with a rear contact passage therethrough to receive the socket contact. The rear shell member is coupled to the front shell member such that the front and rear contact passages are substantially aligned along a contact passage axis. The rear shell member is formed of an integral single piece of non-conductive material. A retention clip is received within at least one of the front and rear contact passages. The retention clip engages the socket contact when the socket contact is loaded into the front and rear contact passages.

DETAILED DESCRIPTION OF THE INVENTION

Figure 1:
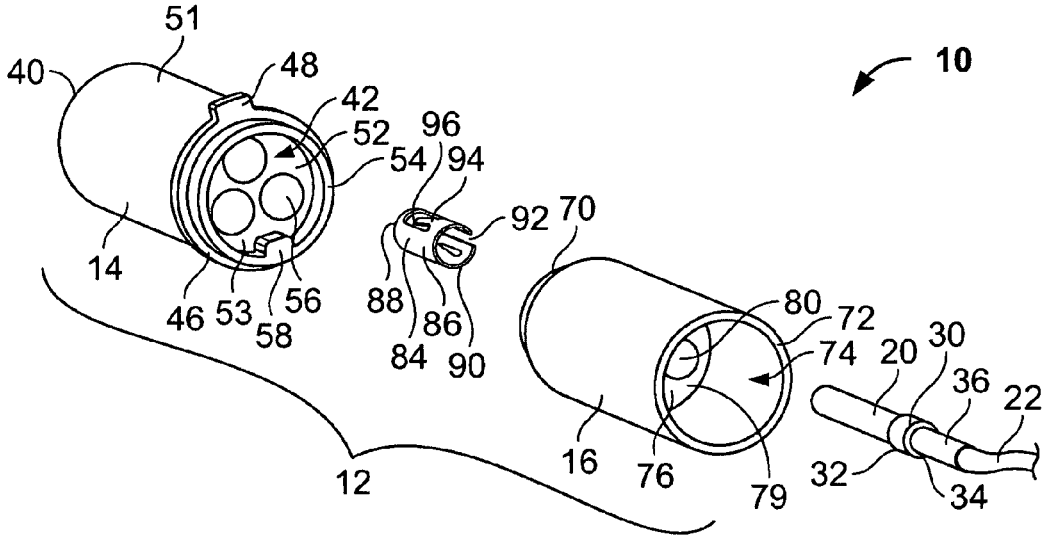
FIG. 1 illustrates an exploded rear isometric view of a socket contact assembly formed in accordance with an embodiment of the present invention.
Figure 2:
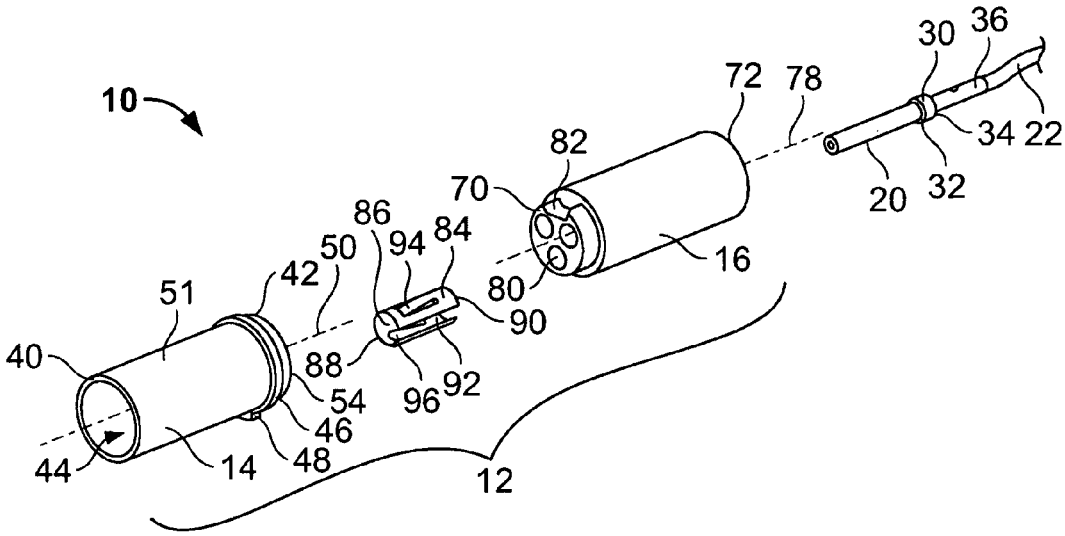
FIG. 2 illustrates an exploded front isometric view of the socket contact assembly shown in FIG. 1.

FIGS. 1 and 2 illustrate exploded front and rear isometric views, respectively, of a socket contact assembly 10 formed in accordance with an embodiment of the present invention. The socket contact assembly 10 includes an outer shell 12 having a front shell member 14 and a rear shell member 16. The front and rear shell members 14 and 16 are configured to be mated to one another to define the outer shell 12. The outer shell 12 defines a connector envelope sized and shaped to meet standards established for Quadrax connectors and to be received in a Quadrax housing (not shown). For example, when assembled, the outer shell 12 defines a connector envelope as established by Aeronautical Radio, Inc. ("ARINC") standards, such as, for example, Arinc 664 standards. Optionally, the outer shell 12 may define a connector envelope substantially similar to a size 8 Quadrax connector envelope. In other embodiments, the contact assembly 10 may be sized to a different standard, such as a Bayonet Neill Concelman (BNC) standard.

The socket contact assembly 10 includes a plurality of socket contacts or inner contacts 20 mounted to corresponding wires 22. The socket contacts 20 are inserted into the front and rear shell members 14 and 16. Optionally, the socket contacts 20 may be power contacts. However, the contacts 20 may be signal or ground contacts. In one embodiment, three socket contacts 20 are inserted into the front and rear shell members 14 and 16, however, the number of socket contacts 20 may depend on the size of the socket contacts 20 and/or the size of the connector envelope. The contacts 20 are each formed with a flared section, or raised surface, 30 defined by a front facing shoulder 32 and a rear facing shoulder 34. The flared section 30 and the shoulders 32 and 34 may be sloped or step-wise. A wire barrel 36 extends rearward from the flared section 30. The wire barrel 36 is hollow and configured to receive the conductors of a corresponding wire 22. The wire barrels 36 may be affixed to corresponding wires 22 in a variety of manners, such as soldering, crimping and the like. As a further option, the overall configuration and shape of the contacts 20 may be varied and may include other contact shapes such as blade portions, or any other well-known contact shape.

The front shell member 14 is generally tubular in shape and is formed with a forward end 40 and a rearward end 42. The forward end 40 defines a mating end of the outer shell 12 and is configured to be joined with a corresponding mating contact assembly, such as a pin contact assembly (not shown). The rearward end 42 defines a rear shell interface. The front shell member 14 is formed from a single integral piece of insulative or dielectric material, such as by injection molding, cast molding, or machining. Optionally, the insulative material may be a plastic material. The front shell member 14 includes a mating cavity 44 proximate and facing the forward end 40. A rim 46 is provided along an outer surface of the front shell member 14, and a tab 48 extends from the rim 46. The tab 48 defines a keying feature for alignment of the front shell member 14. For example, the tab 48 may provide for the physical orientation of the socket contact assembly 10.

The front shell member 14 includes a core portion 52 extending axially along a longitudinal axis 50 of the front shell member 14. The core portion 52 includes a rear face 53 at the rearward end 42 of the front shell member 14. The core portion 42 includes a shroud 51 formed therewith and surrounding the cavity 44. The shroud 51 and core portion 42 being formed of a single insulative material. An interior of the mating cavity 44 is terminated by the core portion 52. A plurality of contact passages 56 are formed through the core portion 52 between the rear face 53 and the cavity 44. The contact passages 56 are formed in a predefined geometry about, and extending parallel to, the longitudinal axis 50 of the contact assembly 10. Optionally, a sleeve portion 54 may extend rearward from the core portion 52 to the rearward end 42 of the front shell member 14. In one embodiment, a keying lug 58 extends radially inward from the sleeve portion 54. The keying lug 58 is configured to orient the front and rear shell members 14 and 16 with one another, as will be described in more detail below.

The rear shell member 16 is generally tubular in shape and is formed with a forward end 70 and a rearward end 72. The forward end 70 defines a front shell interface. The rearward end 72 defines a loading end of the outer shell 12 and is configured to receive the socket contacts 20 during assembly of the socket contact assembly 10. The rear shell member 16 is formed from a single integral piece of insulative material. Additionally, the rear shell member 16 is separable and discrete from the front shell member 14. The rear shell member 16 includes a loading cavity 74 extending from the rearward end 72.

The rear shell member 16 includes a core portion 76 extending axially along a longitudinal axis 78 of the rear shell member 16. The core portion 76 is positioned proximate the forward end 70 of the rear shell member 16 and includes a rear face 79 proximate the rearward end 72. Additionally, the loading cavity 74 is terminated by the rear face 79 of the core portion 76. A plurality of contact passages 80 are formed through the core portion 76 between the forward end 70 and the rear face 79. The contact passages 80 are formed in a predefined geometry about, and extending parallel to, the longitudinal axis 78 of the contact assembly 10. Optionally, the rear shell member 16 has a reduced diameter portion at the forward end 70. In one embodiment, a keying lug 82 extends radially outward from the rear shell member 16 at the reduced diameter portion. The keying lug 82 is configured to orient the front and rear shell members 14 and 16 with one another, as will be described in more detail below.

The socket contact assembly 10 includes a plurality of retention clips 84 received within the contact passages 56 and/or 80 of the front shell member 14 and/or the rear shell member 16, respectively. The retention clips 84 have a tubular body 86 extending between a front end 88 and a rear end 90. Optionally, the retention clip 84 may include a slot or channel 92 extending axially along the body 86. The slot 92 allows the retention clip 84 to expand. The retention clip 84 may also include at least one tab element 94 bent inward from the body 86. The tab element 94 includes an end 96 that is contained within an envelope defined by the retention clip body 86. The tab element 94 is configured to engage the socket contacts 20 when the socket contact assembly 10 is assembled.

During assembly of the socket contact assembly 10, the retention clips 84 are inserted into the contact passages 56 of the front shell member 14. The rear shell member 16 is then mated with the front shell member 14. Optionally, an adhesive may be applied to one of the front and rear shell members 14 and 16 to secure the front and rear shell members 14 and 16 to one another. For example, in one embodiment, an adhesive is applied to the reduced diameter portion of the rear shell member 16, and the reduced diameter portion is inserted into the sleeve portion 54 of the front shell member 14. Optionally, the outer diameter of the reduced diameter portion may be substantially equivalent to the inner diameter of the sleeve portion 54 such that the front and rear shell members 14 and 16 may be securely mated to one another, such as through a friction fit. In one embodiment, the keying lugs 58 and 82 of the front and rear shell members 14 and 16, respectively, are aligned with one another during assembly. The keying lugs 58 and 82 may be used to properly align the contact passages 56 and 80 with one another. Once the front and rear shell members 14 and 16 are mated with one another, the socket contacts 20 are loaded into the rearward end 72, or loading end, of the rear shell member 16. Specifically, the socket contacts 20 are loaded into the contact passages 56 and 80.

Figure 3:
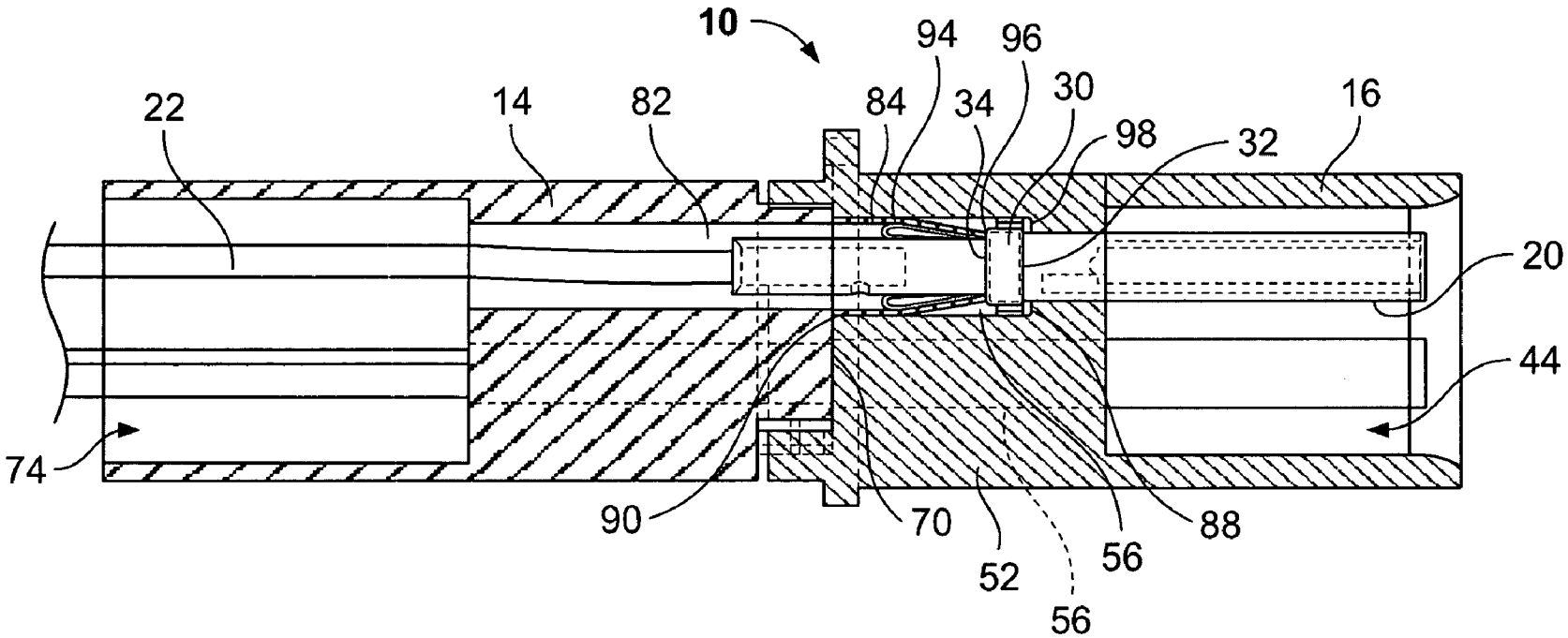
FIG. 3 illustrates a side sectional view of the socket contact assembly shown in FIGS. 1 and 2.

FIG. 3 illustrates a side sectional view of the socket contact assembly 10 with the front and rear shell members 14 and 16 in a mated or assembled state. As illustrated in FIG. 3, the contact passages 56 and 82 are aligned with one another, and the socket contacts 20 are received in the contact passages 56 and 82. Additionally, the socket contacts 20 extend into the mating cavity 44 of the front shell member 14, and the wires 22 extend rearward from the socket contacts 20 into the loading cavity 74 of the rear shell member 16. Optionally, the loading cavity 74 may be loaded with a sealing element, such as, for example, a grommet or potting material.

In one embodiment, the contact passage 56 of the front shell member 14 may be sloped or step-wise. For example, a forward section of the contact passages 56 within core portion 52 may have a smaller diameter than a rear section of the contact passages 56. As such, a shoulder or ledge 98 is defined within the contact passages 56. Optionally, when the retention clips 84 are loaded into the contact passages 56, the retention clips 84 are loaded until the front end 88 of the retention clip 84 engages the shoulder 98. Additionally, the rear end 90 of the retention clip 84 may also engage the rear shell member 16, such as, for example, the forward end 70 of the rear shell member 16. As a result, the retention clips 84 may be sandwiched between the rear shell member 16 and the shoulders 98 of the front shell member 14. In one embodiment, the socket contacts 20 may be loaded into the contact passages 56 and 82 until the front facing shoulder 32 of the flared section 30 of each socket contact 20 engages the shoulder 98 of the front shell member 14. Optionally, the socket contacts 20 may be loaded into the contact passages 56 and 82 until the rear facing shoulder 34 of the flared section 30 of each socket contact 20 is loaded beyond the ends 96 of the tabs 94 of the retention clip 84. As such, the tabs 94 engage the rear facing shoulder 34 of each socket contact 20 to resist removal or rearward movement of the socket contacts 20 within the contact passages 56 and 82.

Figure 4:
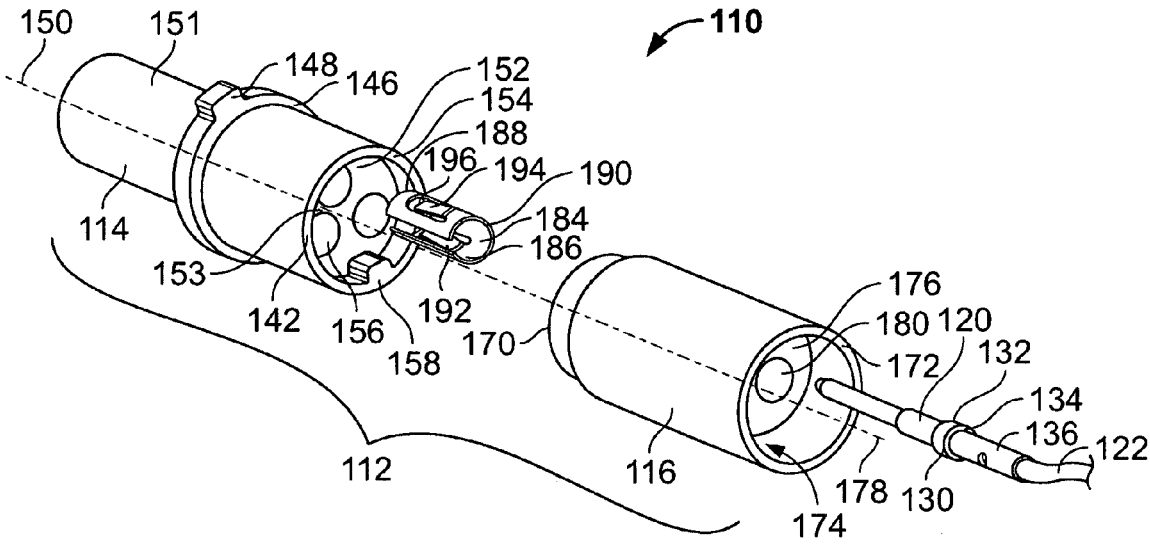
FIG. 4 illustrates an exploded rear isometric view of a pin contact assembly formed in accordance with an embodiment of the present invention.
Figure 5:
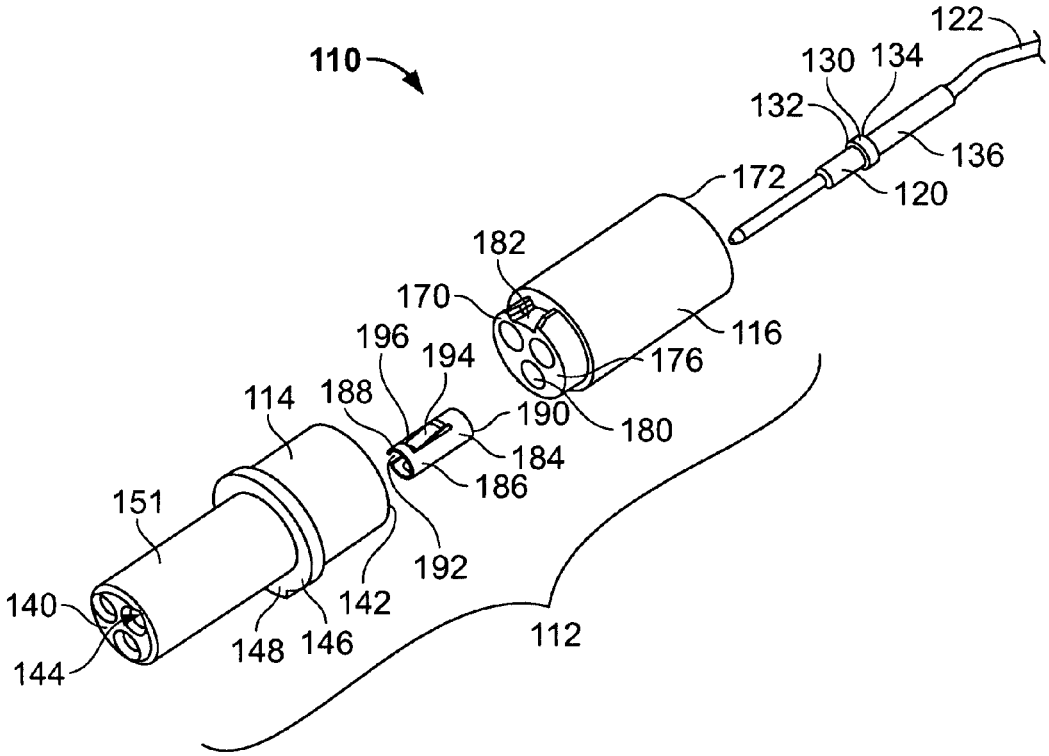
FIG. 5 illustrates an exploded front isometric view of the pin contact assembly shown in FIG. 4.

FIGS. 4 and 5 illustrate exploded front and rear isometric views, respectively, of a pin contact assembly 110 formed in accordance with an embodiment of the present invention. The pin contact assembly 110 includes an outer shell 112 having a front shell member 114 and a rear shell member 116. The front and rear shell members 114 and 116 are configured to be mated to one another to define the outer shell 112. The outer shell 112 defines a connector envelope sized and shaped to meet standards established for Quadrax connectors. For example, when assembled, the outer shell 112 defines a connector envelope as established by Arinc standards, such as, for example, Arinc 664 standards. Optionally, the outer shell 112 may define a connector envelope substantially similar to a size 8 Quadrax connector envelope.

The pin contact assembly 110 includes a plurality of pin contacts or inner contacts 120 mounted to corresponding wires 122. The pin contacts 120 are inserted into the shell members 114 and 116. Optionally, the pin contacts 120 may be power contacts. However, the contacts 120 may be signal or ground contacts. In one embodiment, three pin contacts 120 are inserted into the shell members 114 and 116, however, the number of pin contacts 120 may depend on the size of the pin contacts 120 and/or the size of the connector envelope. The contacts 120 are each formed with a flared section, or raised surface, 130 defined by a front facing shoulder 132 and a rear facing shoulder 134. The flared section 130 and the shoulders 132 and 134 may be sloped or step-wise. A wire barrel 136 extends rearward from the flared section 130. The wire barrel 136 is hollow and configured to receive the conductors of a corresponding wire 122. The wire barrels 136 may be affixed to corresponding wires 122 in a variety of manners, such as soldering, crimping and the like. As a further option, the overall configuration and shape of the contacts 120 may be varied and may include other contact shapes such as blade portions, or any other well-known contact shape.

The front shell member 114 is generally tubular in shape and is formed with a forward end 140 and a rearward end 142. The forward end 140 defines a mating end of the outer shell 112 and is configured to be joined with a corresponding mating contact assembly, such as a socket contact assembly (not shown). The rearward end 142 defines a rear shell interface. The front shell member 114 is formed from a single integral piece of insulative or dielectric material, such as by injection molding or machining. The front shell member 114 includes mating cavities 144 proximate and facing the forward end 140. A rim 146 is provided along an outer surface of the front shell member 114, and a tab 148 extends from the rim 146. The tab 148 defines a keying feature for alignment of the front shell member 114. For example, the tab 148 may provide for the physical orientation of the pin contact 110.

The front shell member 114 includes a core portion 152 extending axially along a longitudinal axis 150 of the front shell member 114. The core portion 152 includes a rear face 153 at the rearward end 142 of the front shell member 114. The core portion 142 includes a shroud 151 formed therewith and surrounding the cavity 144. The shroud 151 and core portion 142 being formed of a single insulative material. An interior of the mating cavity 144 is terminated by the core portion 152. A plurality of contact passages 156 are formed through the core portion 152 between the rear face 153 and the cavity 144. The contact passages 156 are formed in a predefined geometry about, and extending parallel to, the longitudinal axis 150 of the contact assembly 110. Optionally, a sleeve portion 154 may extend rearward from the core portion 152 to the rearward end 142 of the front shell member 114. In one embodiment, a keying lug 158 extends radially inward from the sleeve portion 154. The keying lug 158 is configured to orient the front and rear shell members 114 and 116 with one another, as will be described in more detail below.

The rear shell member 116 is generally tubular in shape and is formed with a forward end 170 and a rearward end 172. The forward end 170 defines a front shell interface. The rearward end 172 defines a loading end of the outer shell 112 and is configured to receive the pin contacts 120 during assembly of the pin contact assembly 110. The rear shell member 116 is formed from a single integral piece of insulative or dielectric material. Additionally, the rear shell member 116 is separable and discrete from the front shell member 114. The rear shell member 116 includes a loading cavity 174 extending from the rearward end 172.

The rear shell member 116 includes a core portion 176 extending axially along a longitudinal axis 178 of the rear shell member 116. The core portion 176 is positioned proximate the forward end 170 of the rear shell member 116 and includes a rear face 179 proximate the rearward end 172. Additionally, the loading cavity 174 is terminated by the rear face 179 of the core portion 176. A plurality of contact passages 180 are formed through the core portion 176 between the forward end 170 and the rear face 179. The contact passages 180 are formed in a predefined geometry about, and extending parallel to, the longitudinal axis 178 of the contact assembly 110. Optionally, the rear shell member 116 has a reduced diameter portion at the forward end 170. In one embodiment, a keying lug 182 extends radially outward from the rear shell member 116 at the reduced diameter portion. The keying lug 182 is configured to orient the front and rear shell members 114 and 116 with one another, as will be described in more detail below.

The pin contact assembly 110 includes a plurality of retention clips 184 received within the contact passages 156 and/or 180 of the front shell member 114 and/or the rear shell member 116, respectively. The retention clips 184 have a tubular body 186 extending between a front end 188 and a rear end 190. Optionally, the retention clip 184 may include a slot or channel 192 extending axially along the body 186. The slot 192 allows the retention clip 184 to expand. The retention clip 184 may also include at least one tab element 194 bent inward from the body 186. The tab element 194 includes an end 196 that is contained within an envelope defined by the retention clip body 186. The tab element 194 is configured to engage the pin contacts 120 when the pin contact assembly 110 is assembled.

During assembly of the pin contact assembly 110, the retention clips 184 are inserted into the contact passages 156 of the front shell member 114. The rear shell member 116 is then mated with the front shell member 114. Optionally, an adhesive may be applied to one of the front and rear shell members 114 and 116 to secure the front and rear shell members 114 and 116 to one another. For example, in one embodiment, an adhesive is applied to the reduced diameter portion of the rear shell member 116, and the reduced diameter portion is inserted into the sleeve portion 154 of the front shell member 114. Optionally, the outer diameter of the reduced diameter portion may be substantially equivalent to the inner diameter of the sleeve portion 154 such that the front and rear shell members 114 and 116 may be securely mated to one another, such as through a friction fit. In one embodiment, the keying lugs 158 and 182 of the front and rear shell members 114 and 116, respectively, are aligned with one another during assembly. The keying lugs 158 and 182 may be used to properly align the contact passages 156 and 180 with one another. Once the front and rear shell members 114 and 116 are mated with one another, the pin contacts 120 are loaded into the rearward end 172, or loading end, of the rear shell member 116. Specifically, the pin contacts 120 are loaded into the contact passages 156 and 180.

Figure 6:
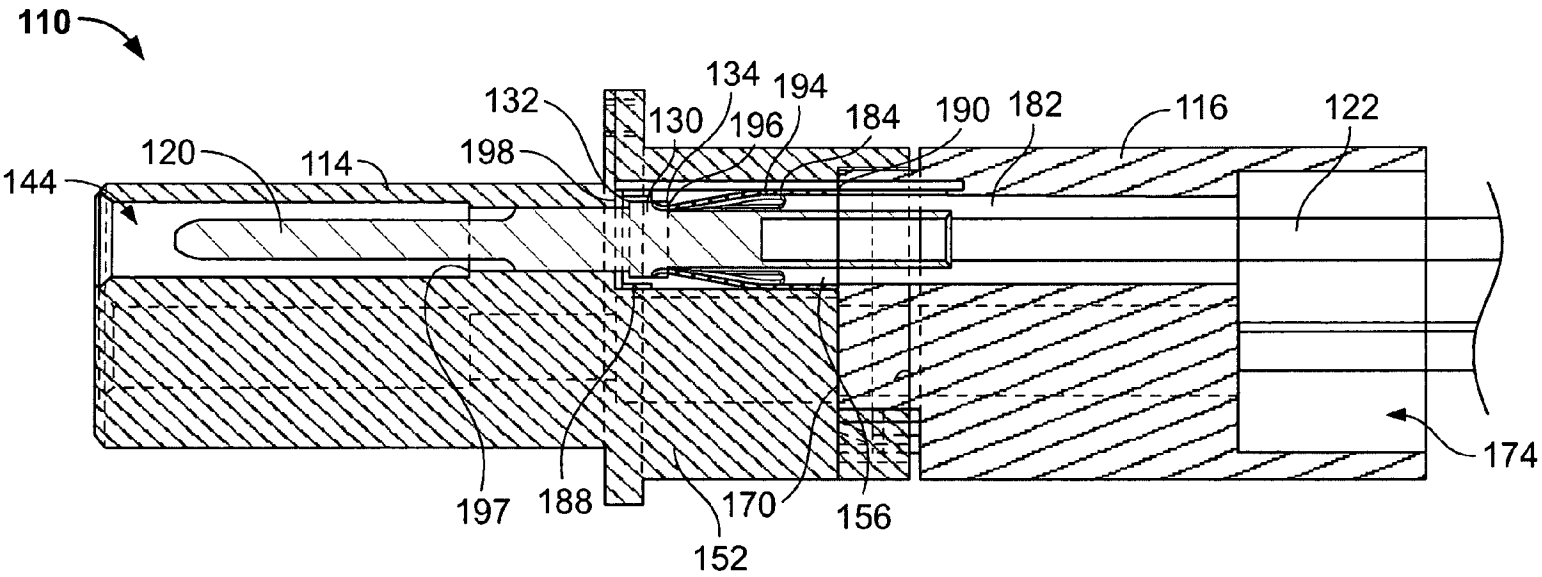
FIG. 6 illustrates a side sectional view of the pin contact assembly shown in FIGS. 4 and 5.

FIG. 6 illustrates a side sectional view of the pin contact assembly 110 with the front and rear shell members 114 and 116 in a mated or assembled state. As illustrated in FIG. 6, the contact passages 156 and 182 are aligned with one another, and the pin contacts 120 are received in the contact passages 156 and 182. Additionally, the wires 122 extend rearward from the pin contacts 120 into the loading cavity 174 of the rear shell member 116, and the pin contacts 120 extend into respective mating cavities 144 of the front shell member 114. Optionally, the mating cavities 144 may have a larger diameter than the contact passages 156 in the front shell member 114. As such, a shoulder 197 may extend between each mating cavity 144 and the corresponding contact passage 156. The shoulder 197 defines a stop or limit for the mating contact assembly during mating of the pin contact assembly 110 and the mating contact assembly. Optionally, the loading cavity 174 may be loaded with a sealing element, such as, for example, a grommet or potting material.

In one embodiment, the contact passage 156 of the front shell member 114 may be sloped or step-wise. For example, a forward section of the contact passages 156 within core portion 152 may have a smaller diameter than a rear section of the contact passages 156. As such, a shoulder or ledge 198 is defined within the contact passages 156. Optionally, when the retention clips 184 are loaded into the contact passages 156, the retention clips 184 are loaded until the front end 188 of the retention clip 184 engages the shoulder 198. Additionally, the rear end 190 of the retention clip 184 may also engage the rear shell member 116, such as, for example, the forward end 170 of the rear shell member 116. As a result, the retention clips 184 may be sandwiched between the rear shell member 116 and the shoulders 198 of the front shell member 114. In one embodiment, the pin contacts 120 may be loaded into the contact passages 156 and 182 until the front facing shoulder 132 of the flared section 130 of each pin contact 120 engages the shoulder 198 of the front shell member 114. Optionally, the pin contacts 120 may be loaded into the contact passages 156 and 182 until the rear facing shoulder 134 of the flared section 130 of each pin contact 120 is loaded beyond the ends 196 of the tabs 194 of the retention clip 184. As such, the tabs 194 engage the rear facing shoulder 134 of each pin contact 120 to resist removal or rearward movement of the pin contacts 120 within the contact passages 156 and 182.

Figure 7:
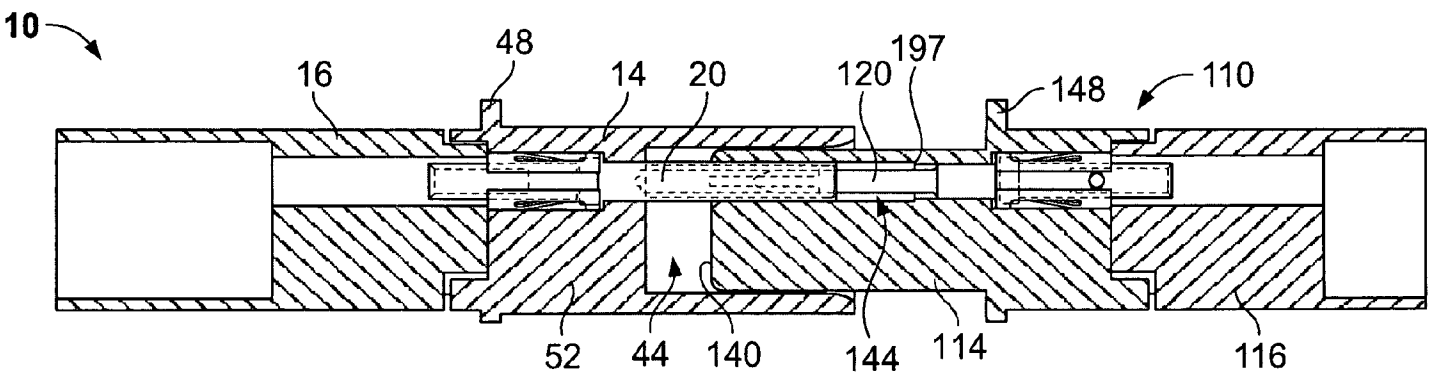
FIG. 7 illustrates a side sectional view of the socket contact assembly shown in FIGS. 1–3 being mated with the pin contact assembly shown in FIGS. 4–6.

FIG. 7 illustrates a side sectional view of the socket contact assembly 10 being mated with the pin contact assembly 110. During mating, the mating end, or forward end 140 of the front shell member 114, of the pin contact assembly 110 is received in the mating cavity 44 of the socket contact assembly 10. Optionally, the tabs 48 and 148 are used to properly align the contact assemblies 10 and 110. When aligned, the socket contacts 20 are aligned with the pin contacts 120. As the contact assemblies 10 and 110 are mated, the socket contacts 20 are received in the mating cavities 144 of the pin contact assembly 110. Additionally, as the contact assemblies 10 and 110 are further mated, the pin contacts 120 are received within the socket contacts 20. The contact assemblies 10 and 110 are mated when the forward end 140 of the front shell member 114 of the pin contact assembly 110 engages the core portion 52 of the front shell member 14 of the socket contact assembly 10. Additionally, the socket contacts 20 may engage the shoulders 197 of the front shell member 114 of the pin contact assembly 110 when the contact assemblies 10 and 110 are mated.

The above-described embodiments provide a cost effective and reliable means for developing a contact assembly 10, 110. Specifically, the contact assembly 10, 110 includes a plurality of power contacts 20, 120 that are configured to be retained and aligned by a pair of dielectric shell members 14 and 16, 114 and 116. The insulative shell members 14 and 16, 114 and 116 also define an outer shell 12, 112 of the contact assembly 10, 110. Moreover, the dielectric shell members 14 and 16, 114 and 116 are sized and dimensioned to have a connector envelope that meets pre-existing Arinc standards, such as, for example, Arinc 664 standards.

Exemplary embodiments of a contact assembly 10, 110 are described above in detail. The contact assembly 10, 110 is not limited to the specific embodiments described herein, but rather, components of each contact assembly 10, 110 may be utilized independently and separately from other components described herein. For example, each contact assembly 10, 110 component can also be used in combination with other contact assembly 10, 110 components.

While the invention has been described in terms of various specific embodiments, those skilled in the art will recognize that the invention can be practiced with modification within the spirit and scope of the claims.

What is claimed is:

1. An electrical contact assembly, comprising:

a plurality of contacts;

a front shell member having a core with a multiple front contact passages therethrough to receive respective ones of said plurality of contacts, said core formed with a shroud extending from a front end of said front shell member, said shroud surrounding and defining a cavity, said front shell member being formed of an integral single piece of non-conductive material; and a rear shell member having a core with a multiple rear contact passages therethrough to receive respective ones of said plurality of contacts, said rear shell member coupled to said front shell member such that said front and rear contact passages are substantially aligned along a contact passage axis, said rear shell member being formed of an integral single piece of non-conductive material; and a retention clip corresponding to each of said plurality of contacts, each retention clip received within at least one of said front and rear contact passages corresponding to each of said plurality of contacts, each said retention clip engaging said corresponding contact when said corresponding contact is loaded into said contact passage.

2. The electrical contact assembly of claim 1, wherein said front and rear shell members define an outer shell dimensioned according to a size 8 Quadrax connector envelope.

3. The electrical contact assembly of claim 1, wherein at least one of said front and rear shell members comprise a keying feature for limiting rotational movement between said front and rear shell members.

4. The electrical contact assembly of claim 1, wherein at least one of said front and rear shell members comprise a keying feature configured to align said front and rear shell members with respect to a mating contact assembly.

5. The electrical contact assembly of claim 1, wherein said retention clip comprises a tubular body and a tab element extending inwardly from said tubular body, said tab element securing said contact with respect to said tubular body.

6. The electrical contact assembly of claim 1, wherein said contact comprises a shoulder, said retention clip engaging said shoulder to limit movement of said contact with respect to said retention clip.

7. The electrical contact assembly of claim 1, wherein said front shell member extends axially between a forward end and a rearward end, said front shell member comprising a sleeve extending from said rearward end, said rear shell member received within said sleeve.

8. The electrical contact assembly of claim 1, wherein said rear shell member extends axially between a forward end and a rearward end, said forward end having a reduced diameter such that said front end of said rear shell member is received within said front shell member.

9. An electrical contact assembly, comprising:

a pin contact;

a front shell member having a core with a front contact passage therethrough to receive said pin contact, said front shell member being formed of an integral single piece of non-conductive material;

a rear shell member having a core with a rear contact passage therethrough to receive said pin contact, said rear shell member coupled to said front shell member such that said front and rear contact passages are substantially aligned along a contact passage axis, said rear shell member being formed of an integral single piece of non-conductive material; and a retention clip received within at least one of said front and rear contact passages, said retention clip engaging said pin contact when said pin contact is loaded into said front and rear contact passages.

10. The electrical contact assembly of claim 9, wherein said front and rear shell members define an outer shell dimensioned according to a size 8 Quadrax connector envelope.

11. The electrical contact assembly of claim 9, wherein at least one of said front and rear shell members comprise a keying feature for limiting rotational movement between said front and rear shell members.

12. The electrical contact assembly of claim 9, wherein said retention clip comprises a tubular body and a tab element extending inwardly from said tubular body, said tab element securing said pin contact with respect to said tubular body.

13. The electrical contact assembly of claim 9, wherein said pin contact comprises a shoulder, said retention clip engaging said shoulder to limit movement of said pin contact with respect to said retention clip.

14. An electrical contact assembly, comprising:

a socket contact;

a front shell member having a core with a front contact passage therethrough to receive said socket contact, said front shell member being formed of an integral single piece of non-conductive material;

a rear shell member having a core with a rear contact passage therethrough to receive said socket contact, said rear shell member coupled to said front shell member such that said front and rear contact passages are substantially aligned along a contact passage axis, said rear shell member being formed of an integral single piece of non-conductive material; and a retention clip received within at least one of said front and rear contact passages, said retention clip engaging said socket contact when said socket contact is loaded into said front and rear contact passages.

15. The electrical contact assembly of claim 14, wherein said front and rear shell members define an outer shell dimensioned according to a size 8 Quadrax connector envelope.

16. The electrical contact assembly of claim 14, wherein at least one of said front and rear shell members comprise a keying feature for limiting rotational movement between said front and rear shell members.

17. The electrical contact assembly of claim 14, wherein said retention clip comprises a tubular body and a tab element extending inwardly from said tubular body, said tab element securing said socket contact with respect to said tubular body.

18. The electrical contact assembly of claim 14, wherein said socket contact comprises a shoulder, said retention clip engaging said shoulder to limit movement of said socket contact with respect to said retention clip.

19. The electrical contact assembly of claim 1, wherein said front shell member and said rear shell member are formed of the same type of material.

20. The electrical contact assembly of claim 1, wherein said contact constitutes a power contact.

* * * * *